United States Patent [19]

Humphries et al.

[11] 4,356,474

[45] Oct. 26, 1982

[54] ALARM SYSTEM

[75] Inventors: Peter Humphries, Bolton; Paul Aeberli, Tottenham, both of Canada

[73] Assignee: Contronic Controls Limited, Mississauga, Ontario, Canada

[21] Appl. No.: 241,268

[22] Filed: Mar. 6, 1981

[30] Foreign Application Priority Data

Mar. 6, 1980 [CA] Canada ..... 347124

[51] Int. Cl.[3] ..... G08B 19/00

[52] U.S. Cl. ..... 340/509; 340/510; 340/533; 340/508

[58] Field of Search ..... 340/500, 506, 508, 509, 340/510, 512, 531, 533, 534, 521

[56] References Cited

U.S. PATENT DOCUMENTS

| | | | |
|---|---|---|---|
| 4,185,277 | 1/1980 | Corso | 340/508 |
| 4,215,340 | 7/1980 | Lejon | 340/508 |
| 4,253,091 | 2/1981 | Frydman | 340/508 |

*Primary Examiner*—Alvin H. Waring

*Attorney, Agent, or Firm*—Rogers, Bereskin & Parr

[57] ABSTRACT

A digital alarm system of the type having first and second electrically conductive loops connected by an alarm switch. The alarm switch is normally open, but can be closed when an alarm state exists to electrically short one loop to the other. Currents are generated in each of the loops for use in detecting either the closing of the alarm switch or the occurrence of a fault in one of the loops. Resistors are connected to each of the loops for use in detecting the presence or absence of the currents. A first pair of transistor switches alternatingly short-circuit one resistor then the other; and a second pair of transistor switches, synchronized with the first pair, alternatingly short the ends of one loop then those of the other so that when the alarm switch is closed the first pair of transistor switches simultaneously short-circuit both resistors even if a fault occurs anywhere in one of the loops. Recording devices, such as flip-flops, coupled to the resistors, record signals indicative of a magnitude of the resistor voltage drops during intervals in which the resistors are not short-circuited. Logic circuitry is then used to process this stored information to generate signals indicating whether the alarm switch has been tripped or whether a fault has occurred.

5 Claims, 3 Drawing Figures

ALARM SYSTEM

Figure 1:
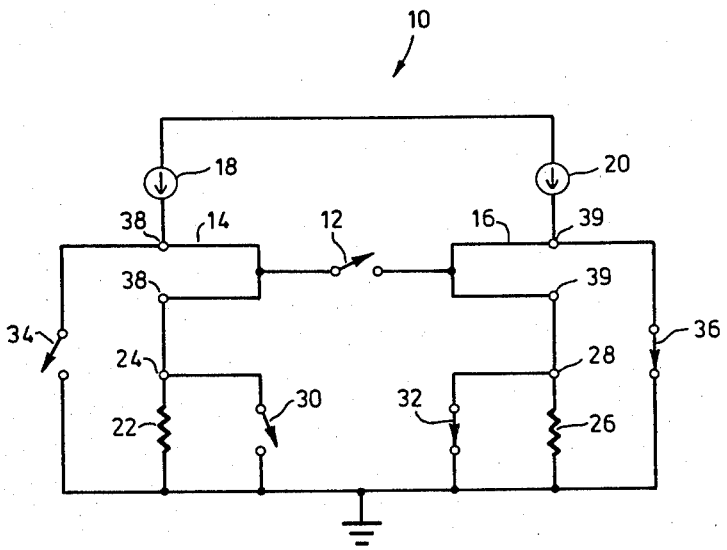

The invention relates to a digital alarm system in which the closing of an alarm switch causes an alarm signal to be generated.

A conventional fire alarm is fairly typical of such systems. The fire alarm switch is generally located some distance from the apparatus which actually generates the alarm signal, and lengths of wire couple the alarm switch to the alarm generating apparatus so that the closing of the alarm switch can be detected. Difficulties can arise owing to the fact that a break in the wire and in some cases a shorting of the wire to another point in the alarm system can produce an electrical state indistinguishable from that of the open alarm switch. In such circumstances the closing of the alarm switch may not activate an alarm signal.

The problem of detecting such faults has in the past been overcome by running a loop of wire, rather than a single length of wire, to each of the alarm switch terminals and generating a current in each of the loops. The presence or absence of these currents, which can be detected by monitoring the voltage drop across a resistor located in each of the loops, will then indicate whether a fault has occurred. The alarm generating apparatus can then be appropriately adapted to generate a signal indicating the existence of a fault, as well as an alarm signal.

The conducting loops used in such a system, especially when they are fairly lengthy, have a tendency to pick up extraneous electromagnetic noise. Such noise may generate false alarm and fault signals. This may particularly be the case if the alarm system is designed for analog operation in which multiple voltage levels must be detected accurately to discriminate between normal, alarm and fault states. In such circumstances, a digital alarm system in which the presence of absence of a specific voltage level is detected can sometimes provide improved noise immunity.

The invention provides a digital alarm system comprising first and second electrically conductive loops, and current generating means for generating first and second currents in the first and second loops, respectively.

A first resistor is electrically coupled to a first loop so that the first current produces a voltage drop across the first resistor. The first resistor is so located that a fault occurring in the first loop, either a break or an electrical shorting to ground, causes the magnitude of the voltage drop across the first resistor to drop to zero. The voltage drop across first resistor provides information concerning the electrical integrity of the first loop.

Similarly, a second resistor is electrically coupled to the second loop so that the second current produces a voltage across the second resistor. The second resistor is so located that a fault occurring in the second loop causes the magnitude of the voltage drop across the second resistor to drop to zero. In this manner, the voltage drop across the second resistor provides information concerning the electrical integrity of the second loop.

An alarm switch is electrically connected between the first and second loops. The alarm switch is normally open and electrically shorts the first loop to the second loop when the alarm switch is closed as in response to an alarm condition.

The alarm system is provided with first switching means which alternatingly short-circuit the first and second resistors. Recording means coupled to the first and second resistors produce first and second state signals respectively indicative of the magnitude of the voltage drop existing across each of the first and second resistors during the most recent time interval in which the resistor was not shorted by the first switching means. The first state signal has a first value when the voltage drop across the first resistor corresponds to that produced by the first current and a second value when the voltage drop is substantially zero. Similarly, the second state signal has a first value when the voltage drop across the second resistor corresponds to that produced by the second current and a second value when the voltage drop is zero.

The alarm system is provided with second switching means which alternatingly short the ends of the first loop to one another and the ends of the second loop to one another. The second switching means is synchronized with the first switching means so that the ends of the first loop are shorted together when the first resistor is short-circuited and the ends of the second loop are shorted when the second resistor is short-circuited. The second switching means ensure that the first switching means will simultaneously short-circuit both the the first and second resistors when the alarm switch is closed, even if a fault has occurred anywhere in one of the loops.

The alarm system includes fault and alarm signal generating means electrically coupled to the recording means. The fault signal generating means generate a fault signal when one of the first or second state signals assumes its second value. The alarm signal generating means generate an alarm signal when both the first and second state signals have their second values. In a preferred embodiment, the alarm system includes fault signal suppressing means for suppressing the generation of a fault signal when the alarm signal is generated.

Figure 2:
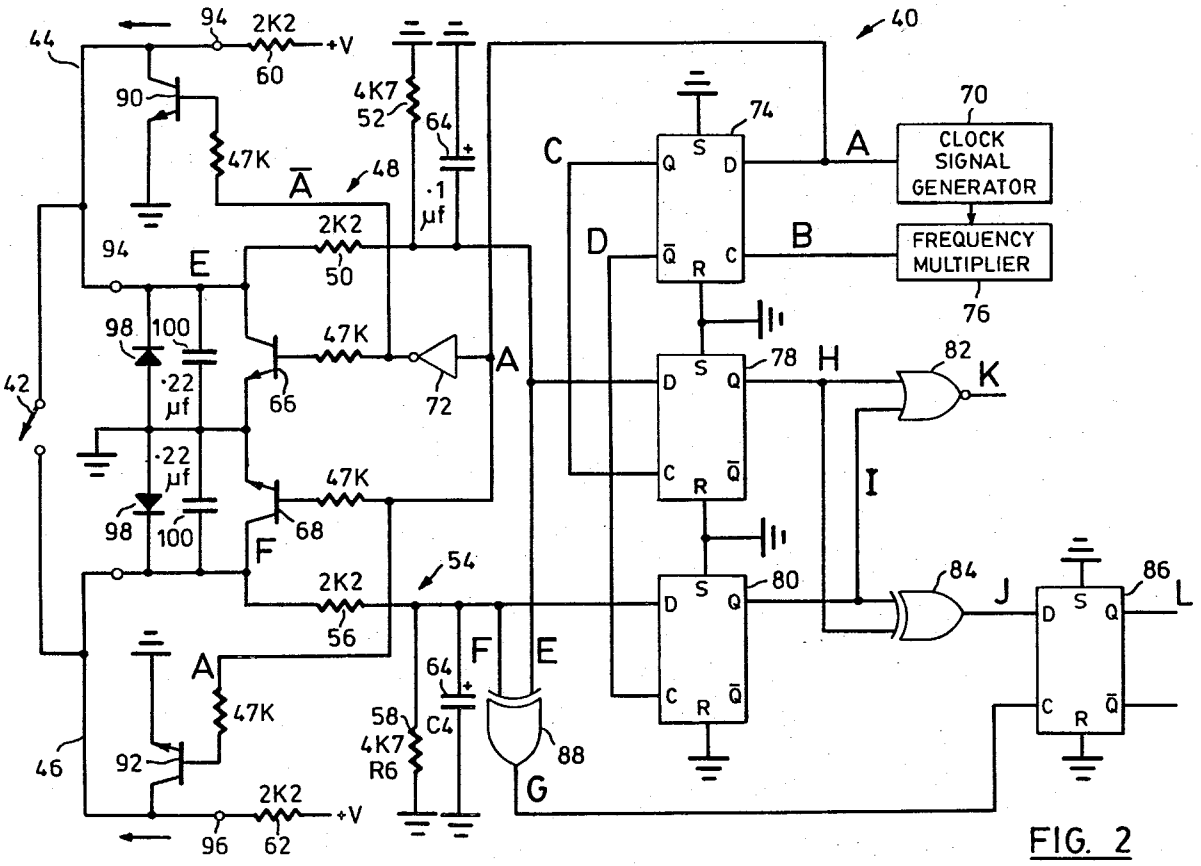
Figure 3:
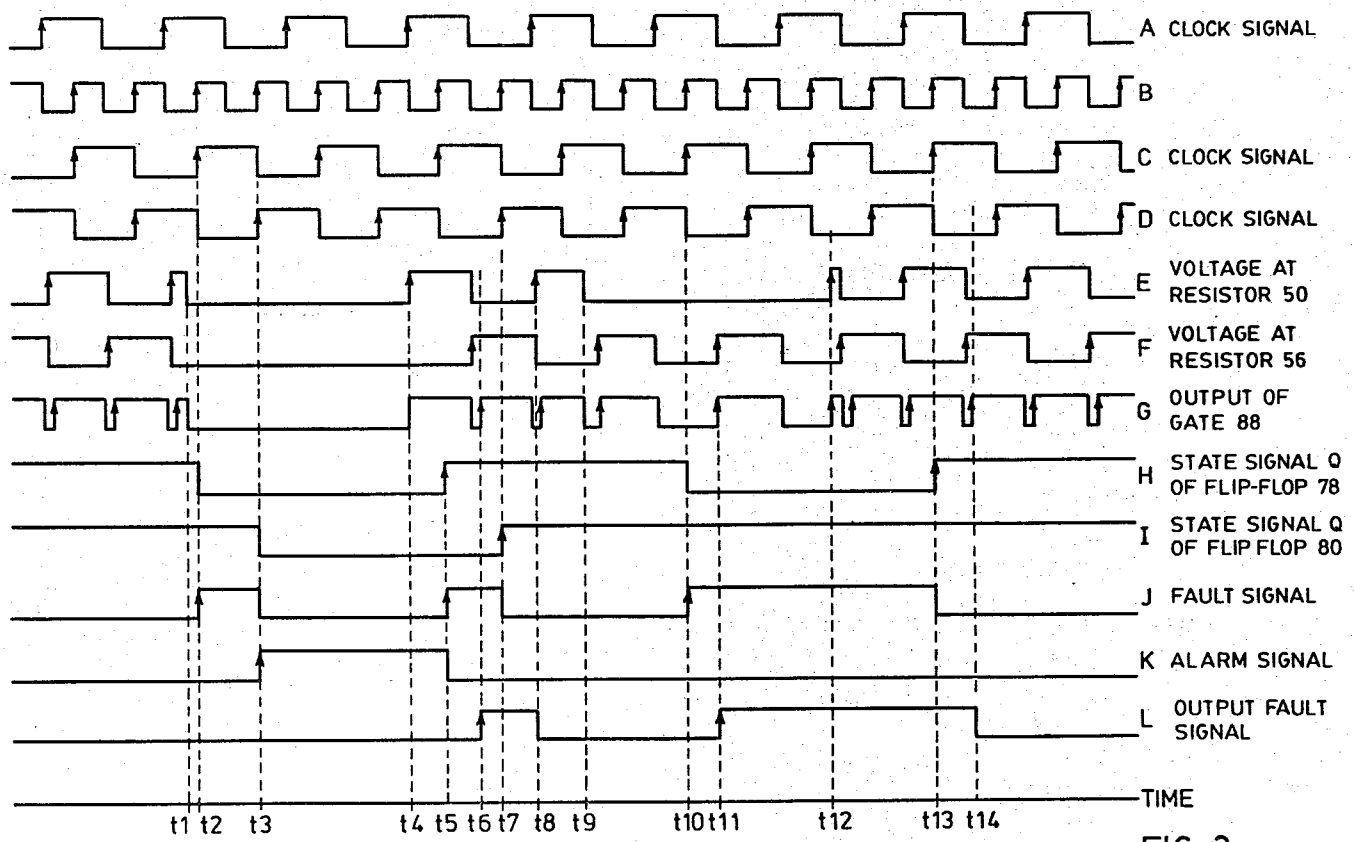

The invention will be better understood with the reference to drawings in which:

FIG. 1 diagrammatically illustrates certain basic structure of an alarm system constructed according to the invention;

FIG. 2 is a diagrammatic representation of a preferred embodiment of the invention; and, FIG. 3 is a timing diagram illustrating the relationship between various signals generated in the preferred embodiment.

Reference is made to FIG. 1 which illustrates an alarm system 10 including an alarm switch 12. The alarm switch 12 might be, for example, a manually activated fire alarm switch mounted on a wall, a burglar alarm switch located in a door and activated by the opening of the door or the like. In practice the alarm switch 12 can be remotely located and can be electrically connected to the remainder of the alarm system 10 by first and second electrically conductive loops 14, 16. The alarm switch 12 is normally open, but can be closed to electrically short the first and second loops 14, 16 in response to an alarm state.

The alarm system 10 includes first and second current sources 18, 20 which generate first and second currents in the first and second loops 14, 16 respectively. A first resistor 22 serves as means for sensing the first current, the resistor 22 causing at a terminal 24 a first voltage signal whose magnitude is indicative of the presence of absence of the first current. Similarly, a second resistor 26 causes at a terminal 28 a second voltage signal whose magnitude is indicative of the presence or absence of the second current. These voltage signals can provide information from which logic circuitry, described more fully below, can determine whether alarm or fault states have occurred.

In the alarm system 10 an alarm state is sensed when the first and second voltage signals drop to and remain at zero volts with respect to ground. It will be appreciated that the closing of the alarm switch 12 will not alone cause the first and second voltage signals to drop to zero volts. The alarm system 10 is consequently provided with first and second synchronized switch 30, 32 which alternatingly short-circuit the resistors 22,26. Absent an alarm state, only one of the resistors 22, 26 will be short-circuited at any given time; however, when the alarm switch 12 is closed, one of the switches 30, 32 will at any given time be simultaneously short-circuiting both resistors 22, 26 and consequently both the first and second voltage signals will drop to and remain at zero volts.

In the alarm system 10 a fault condition is sensed when one and only one of the first and second voltage signals drops to and remains at zero volts. It will be appreciated that when a fault occurs one of the voltage signals remains at zero volts while the other voltage signal, owing to the operation of the switches 30,32, will vary periodically between the voltage induced by the first and second currents and zero volts. Thus, for a portion of any given period, the voltage signals produced by a fault will tend to resemble those produced by the closing of the alarm switch 12. To avoid confusion the alarm system 10 is provided with recording means, described more fully below, which record signals indicative of the magnitudes of the first and second voltages during those time intervals in which the first and second resistors 22, 26 are not short-circuited. When the alarm switch 12 is closed, these recorded signals will indicate that both first and second voltage signals are remaining continuously at zero volts; and, when a fault occurs, these recorded signals will indicate that only one of the first and second voltage signals is remaining continuously at zero volts.

The alarm system 10 is provided with third and fourth synchronized switches 34, 36 which serve to alternatingly short the ends 38 of the first loop 14 to one another and the ends 39 of the second loop 16 to one another. The switches 34,36 are synchronized with the switches 30, 32 so that the ends 38 of the first loop 14 are shorted together when the first resistor 22 is short-circuited and the ends 39 of the second loop 16 are shorted together when the second resistor 26 is short-circuited. The switches 34, 36 ensure that the resistors 22, 26 will be simultaneously short-circuited when the alarm switch 12 is closed regardless whether a single break occurs in either of the first and second loops 14, 16. For example, if a break were to occur at a location generally indicated by the letter X in the first loop 14 then, without the switch 34, the switch 30 would not be able to simultaneously short-circuit the resistors 22, 26 when the alarm switch 12 is closed. Consequently, the first and second voltage signals would indicate the existence of a fault rather than an alarm state. However, the switch 34 which shorts the ends 38 of the first loop 14 (through the swtch 30), effectively permits the break to be by-passed so that the switch 30 can short-circuit the resistor 26. (It should be noted that a switch performing the function of the switch 34 can be connected directly across the terminals 38 to directly short them together if desired). It will be appreciated that the occurrence of a double break, one break being adjacent to each of the terminals 38, would frustrate the detection of a closing of the alarm switch 12; however, a fault signal would stil occur. It will further be appreciated that the occurrence of faults simultaneously in both loops 14, 16 will cuse alarm rather than fault signals to be generated.

Reference is next made to FIG. 2 which illustrates an alarm system 40 comprising an alarm switch 42 connected between first and second electrically conductive loops 44, 46. The alarm switch 42 is normally open as indicated, but can be closed to electrically short the first and second loops 44, 46 in response to an alarm state.

A voltage supply V generates first and second currents, generally indicated by arrows, in the first and second loops 44, 46 respectively. A first resistive voltage divider 48 comprising resistors 50, 52 serves as means for detecting the first current, while a second resistive voltage divider 54 comprising resistors 56, 58 serves as means for detecting the second current. The resistance values of the first and second voltage dividers 48, 54 and resistors 60, serve in part to fix the magnitudes of the first and second currents.

Capacitors 64 are electrically connected as shown to the resistive dividers 48, 54 to attentuate voltage spikes which might otherwise appear in the differential voltage occurring across each of the resistors 52, 58 owing to electromagnetic noise. It will be appreciated that voltage dividers 48, 54 have been used instead of single resistors to permit limiting of peak voltage to the logic circuitry and capacitive filtering illustrated, and that they do not otherwise significantly affect the operation of the alarm system 40.

First and second transistors 66, 68 alternatingly short-circuit the first and second resistive voltage dividers 48, 54. The first and second transistors 66, 68 are driven by a first square wave clock signal, generally indicated by the letter A in FIG. 3. (FIG. 3 diagrammatically shows various signals in the system relative to a line 69 representing the passage of time). The first clock signal A is generated by a conventional clock signal generator 70 that may typically be a multivibrator. The first clock signal A is applied directly to the base of the inverter 72 to produce clock signal $\overline{A}$ which is applied to the base of the first transistor 66. Consequently, except for transition periods and except when the alarm switch 42 is closed, only one of the first and second transistors 66, 68 will be turned on at any time and only one of the first and second resistive voltage dividers 48, 54 will be short-circuited at any time.

Third and fourth transistors 90,92 alternatingly short the ends 94, 96 of the first and second loops 44, 46. The third transistor 90 is driven by the clock signal $\overline{A}$ (i.e. it is turned on when signal $\overline{A}$ is high) so that the ends 94 of the first loop 44 are shorted when the first resistive divider 48 is short-circuited by the first transistor 66. The fourth transistor 92 is driven by the first clock signal A so that the ends 96 of the second loop 46 are shorted when the second resistive divider 54 is short-circuited by the second switch 68. In this manner, the third and fourth transistors 90, 92 ensure that either of the transistors 66, 68 when turned on by the first clock signal can simultaneously short-circuit both resistive dividers 48, 54 when the alarm switch 42 is closed, even when a single break occurs anywhere in one of the first or second loops 44, 46. It will be appreciated that the transistors 90, 92 short the ends 94, 96 respectively through the transistors 66, 68, all of which are electrically connected to shunt the ends 94, 96 by virtue of their common ground connections.

Second and third clock signals C, D are generated at the output terminals Q and $\overline{Q}$ of a flip-flop 74. These signals are used to clock two other flip-flops, described more fully below, which record information respecting the presence or absence of a first and second current.

The flip-flop 74 is adapted to record the logic high or low value of a signal received at its data terminal Da when a signal at its clock terminal C1 moves from a logic low to a logic high value. The flip-flop 74 will consequently be triggered to record by any leading edge of the clock signal applied to the C1 terminal.

The Da terminal of the flip-flop 74 is connected to the clock signal generator 70 to receive the first clock signal referred to above. The C1 terminal is connected to a conventional frequency multiplier 76 that produces from the first clock signal the signal generally indicated by the letter B in FIG. 3. (Signal B has twice the frequency of Signal A). The effect of these input signals is to produce at the Q and $\overline{Q}$ output terminals respectively the second and third clock signals C, D in FIG. 3.

The leading edges of the signals in FIG. 3 have been indicated by vertical arrows to better illustrate the relative phase shifting of the various signals. It will be appreciated that the second and third clock signals C, D are substantially identical to the first clock signal A except that they are respectively 90 and 270 degrees phase shifted with respect to the first clock signal.

Two flip-flops 78,80 are respectively connected to the first and second voltage dividers to store the logic high or logic low values of the voltage drop across each of the first and second resistive dividers 48, 54. These appear as first and second state signals H, I (FIG. 3) generated at the Q output terminals of the flip-flops 78, 80.

The flip-flops 78, 80 operate in substantially the same manner as the flip-flop 74 referred to above, being triggered by the leading edge of clock signals received at the C1 terminals to produce changes in the first and second state signals H, J. Since the second and third clock signals are phase shifted with respect to the first clock signal as described above, the flip-flops 78, 80 tend to change the state signals only in response to the magnitudes of the voltage drops sensed across the resistive dividers 48, 54 at substantially the mid-points of those time intervals in which the resistive dividers 48, 54 are not short-circuited by the transistors 66, 68. The state signals H, J are at a logic high value, namely, the positive voltage, if the resistor divided voltage sensed corresponds to that induced by the first and second currents, and at a logic low value, namely, zero volts, if the resistor divider voltage sensed is substantially zero units as when a fault occurs or the alarm switch 42 is closed. For example, when the system is functioning normally and there is no fault or alarm, then whenever the leading edge of clock signal C is applied to the C1 input of flip-flop 78, signal $\overline{A}$ will be low and the voltage of resistor 50 (i.e. signal E) will be high. Therefore, state signal H will always be high in the absence of an alarm or fault. Similarly, absent any fault or alarm, that whenever the leading edge of clock signal D is applied to the C1 terminal of flip-flop 80, clock signal A is low, resistor 56 is high (and so therefore is the signal F applied to the Da terminal of flip-flop 80), and therefore state signal I will always be high absent an alarm or fault. State signal H thus records the magnitude of the voltage drop existing across first resistor 50 during the most recent interval when this resistor was not shorted. State signal J records the same for second resistor 56.

An alarm signal K is generated by a conventional nor gate 82 electrically connected to the flip-flop 78, 80 as shown. The nor gate generates an alarm signal K, a logic high signal at its output terminal, when both the first and second state signal H, J have assumed a logic low value, indicating that neither of the resistive voltage dividers 48, 54 is sensing either of the first and second currents. This will occur when the alarm switch 42 is closed, as the transistors 76, 78 will now short both resistive dividers 48, 54 to ground when either transistor is turned on.

A fault signal J is generated by a conventional exclusive or gate 84 connected to the flip-flops 78, 80 as shown. The exclusive or gate 84 generates the fault signal, a logic high value at its output terminal, when the first and second state signals H, J applied to its inputs are not the same value, indicating that one of the first and second currents cannot be sensed. It will be appreciated that the alarm system 40 is not adapted to detect a double fault, namely, a fault affecting the current flows in both the first and second loops 44, 46. In such circumstances, an alarm signal would be generated.

The generation of the fault signal J is effectively suppressed by a flip-flop 86 clocked by an exclusive or gate 88, when the alarm switch 42 is closed and an alarm signal K generated. In the absence of an alarm condition or a fault, the output signal G of the exclusive or gate 88 will generally be at a logic high value except during those transition periods when the transistors 66, 68 are switching, due to the difference in the charge and discharge time of capacitors 64, 100. During these transition periods, the output signal of the exclusive or gate 88 will drop to a logic low value and then return to a logic high. The output signal G of the exclusive or gate 88 will consequently provide a regular series of leading edges to clock the flip-flop 86 to permit the Q output signal to change to a logic high value in response to a fault signal. When a fault has occurred, the output signal of the exclusive or gate will produce a leading edge twice in each period of any clock signal, to clock the flip-flop 86, producing an output fault signal L. However, when the alarm switch 42 is closed, causing both resistive dividers 48, 54 to be continuously short-circuited, the output signal of the exclusive or gate 88 remains at a logic low value preventing the flip-flop 86 from effectively passing any alarm signal which might occur. In this manner, the simultaneous generation of alarm and fault signals is prevented.

Lastly, it should be noted that the alarm system 40 is provided with diodes 98 and capacitors 100 connected as shown between the collectors and emitters of the transistors 66, 68. The diodes 98 are intended to clip negative voltage spikes and the capacitors 100 are intended to generally reduce the magnitude of transient voltage spikes, which voltage spikes might be induced in the first and second loops 44, 46 and might otherwise tend to damage the transistors 66, 68.

The operation of the alarm system 40 will next be described in more detail with reference to FIG. 3, and with reference to the time line 69.

Assume that at a point in time t1, the alarm switch 42 is closed. The resistive divider voltages E, F then assume a logic low value. At the same time, the output signal G of the exclusive or gate 88 assumes and remains at a logic low value thereby preventing the flip-flop 86 from passing a fault signal. At a point in time t2, the flip-flop 78 is triggered by the second clock signal C to record the logic value of the resistive divider voltage E and consequently the first state signal H drops to a logic low value. At the same time, the exclusive or gate 84 responds to the drop in the first state signal H, causing its output signal J to assume a logic high value, erroneously indicating the existence of a fault state. This fault signal is not passed, however, by the flip-flop 86 as the output signal G of the exclusive or gate 88 cannot provide a leading edge to clock the flip-flop 86. At a point in time t3, the flip-flop 80 is triggered by the third clock signal to record the logic value of the second resistive divider voltage F, whereby the second state signal I drops to a logic low value. Since both the signals H, I are now at a logic low value, the output signal J of the exclusive or gate 84 also drops to a logic low value, eliminating the erroneous fault signal, and the output signal K of the nor gate 82 rises to a logic high value indicating an alarm state.

Next, assume that at a point in time t4, the alarm switch 42 is restored to an open state. The first resistive divider voltage E then rises to a logic high value. At a point in time t5, the flip-flop 78 is triggered by the second clock signal C to record the logic value of the first resistive divider voltage E and the first state signal H consequently rises to a logic high value. The nor gate 82 senses this rise in the first state signal H and the alarm signal is suppressed as the output signal K of the nor gate 82 once again assumes a logic low value.

At the point in time t5, because the second state signal I has not yet been restored to a logic high value, the output signal J of the exclusive or gate 84 rises to a logic high value, once again erroneously indicating the existence of a fault state. At a point in time t6, the flip-flop 86 is triggered by the output signal G of the exclusive or gate 88 to pass the erroneous fault signal and consequently the signal L at the output terminal Q of the flip-flop 86 rises to a logic high value. At a point in time t7, the flip-flop 80 is triggered by the third clock signal D to record the logic value of the second resistive divider voltage F and the second state signal I consequently rises to the logic high value. Since both state signals H, I are now at a logic high value, the output signal J of the exclusive or gate 84 drops to a logic low value, eliminating the erroneous fault signal. At a point in time t8, the signal G triggers the flip-flop 86 to pass the logic value of the signal J and consequently the output signal L of the flip-flop 86 once again assumes a logic low value reflecting the absence of the fault state. It will be appreciated that the erroneous fault signal generated when the alarm switch 42 is restored to an open state is of relatively short duration, substantially one-half of the period of the first clock signal, and should not significantly affect the operation of the alarm system 10.

Assume next that at a point in time t9, a fault occurs in the first loop 14. The resistive divider voltage E then drops to and remains at a logic low value. At a point in time t10, the flip-flop 78 is triggered by the second clock signal C in response to the drop in the resistive divider voltage E, causing the first state signal H to drop to a logic low value. The exclusive or gate 84 responds to the drop in the first state signal by generating a fault signal, the output signal J of the exclusive or gate 84 rising to a logic high value. At a further point in time t11, the flip-flop 86 is triggered by a leading edge in the signal G to pass the fault signal generated by the exclusive or gate 84 and the output signal L of the flip-flop 86 consequently rises to a logic high value.

Assume that at a point in time t12, the fault is corrected. The resistive divider voltage E then rises to a logic high value. At a point in time t13, the flip-flop 78 is triggered by the second clock signal C to record the logic value of the resistive divider voltage E and consequently the first state signal H rises to a logic high value. Since both the first and second state signals H, I are now at a logic high value, the output signal J of the exclusive or gate 84 drops to a logic low value, reflecting the absence of a fault condition. At a further point in time t14, a leading edge in the signal G causes the flip-flop 86 to respond to the drop in the signal J and the output signal L of the flip-flop 86 also drops to a logic low value.

In the alarm system 10 a variety of flip-flops and logic gates have been used to make decisions concerning the existence of fault and alarm states. It will be appreciated that more sophisticated equipment such as a microprocessor could be used to perform these functions.

We claim:

1. A digital alarm system, comprising:

first and second electrically conductive loops;

current generating means electrically connected to the first and second loops for generating a first current in first loop and a second current in the second loop;

a first resistor electrically connected to the first loop so that the first current produces a first current produced voltage across the first resistor and so that a break in the first loop or an electrical shorting of the first loop to a ground point causes the magnitude of the voltage drop across the first resistor to drop to zero;

a second resistor electrically connected to the second loop so that the second current produces a second current produced voltage across the second resistor and so that a break in the second loop or an electrical shorting of the second loop to a ground point causes the magnitude of the voltage drop across the second resistor to drop to zero;

an alarm switch electrically connected between the first and second loops and adapted to electrically short the first loop to the second loop when closed;

first switching means electrically connected to the first and second resistors for alternatingly short-circuiting the first and second resistors;

second switching means connected to the first and seconmd loops and synchronized with the first switching means for alternatingly shorting the ends of the first loop to one another and the ends of the second loop to one another, so that the ends of the first loop are shorted together when the first resistor is short-circuited and the ends of the second loop are shorted together when the second resistor is short-circuited;

recording means electrically coupled to the first and second resistors for producing a first state signal indicative of the magnitude of the voltage drop existing across the first resistor during the most recent time interval in which the first resistor was not short-circuited by the first switching means, the first state signal having a first value when the first resistor voltage drop corresponds to the first current produced voltage and a second value when the first resistor voltage drop is substantially zero, and a second state signal indicative of the magnitude of the voltage drop existing across the second resistor during the most recent time interval in which the second resistor was not short-circuited by the first switching means, the second state signal having a first value when the second resistor voltage drop corresponds to the second current produced voltage and a second value when the second resistor voltage drop is substantially zero;

alarm signal generating means electrically coupled to the recording means for generating an alarm signal when both the first and second state signals have their second values; and, fault signal generating means electrically coupled to the recording means for generating a fault signal when one of the first and second state signals assumes its second value.

2. A digital alarm system as claimed in claim 1, including fault signal suppressing means coupled to the fault signal generating means for suppressing the generation of the fault signal when the alarm signal is generated.

3. A digital alarm system as claimed in claim 1 in which the first switching means comprise:

first and second switching devices respectively shunting the first and second resistors, the first and second devices being adapted to be triggered by a first clock signal to alternatingly short-circuit the first and second resistors; and, first clock means for generating the first clock signal.

4. A digital alarm system as claimed in claim 3 in which the second switching means comprise third and fourth switching devices respectively connected to the first and second loops, the third and fourth devices being adapted to be triggered by the first clock signal to alternatingly short the ends of the first loop to one another and the ends of the second loop to one another.

5. An alarm system as claimed in claim 3 in which the storage means comprise:

a first flip-flop electrically coupled to the first resistor and adapted to be triggered by a second clock signal to produce the first state signal in response to the magnitude of the first resistor voltage drop at the time the first flip-flop is triggered by the second clock signal;

a second flip-flop electrically coupled to the second resistor and adapted to be triggered by a third clock signal to produce the second state signal in response to the magnitude of the second resistor voltage drop at the time the second flip-flop is triggered by the third clock signal; and, second clock means electrically coupled to the first and second flip-flops for generating the second and third clock signal, the second and third clock signals being phase shifted with respect to the first clock signal so that the flip-flops respond to the magnitudes of the first and second resistor voltages during time intervals in which the first and second resistors are not short-circuited by the first switching means.

* * * * *